US010028545B2

(12) United States Patent
Ikenaka et al.

(10) Patent No.: US 10,028,545 B2
(45) Date of Patent: Jul. 24, 2018

(54) SHOE UPPER, AND METHOD FOR KNITTING SHOE UPPER

(71) Applicant: SHIMA SEIKI MFG., LTD., Wakayama-shi, Wakayama (JP)

(72) Inventors: Masamitsu Ikenaka, Wakayama (JP); Kenta Terai, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 59 days.

(21) Appl. No.: 15/127,480

(22) PCT Filed: Feb. 25, 2015

(86) PCT No.: PCT/JP2015/055450

§ 371 (c)(1),
(2) Date: Sep. 20, 2016

(87) PCT Pub. No.: WO2015/146444

PCT Pub. Date: Oct. 1, 2015

(65) Prior Publication Data

US 2017/0135435 A1 May 18, 2017

(30) Foreign Application Priority Data

Mar. 28, 2014 (JP) ..... 2014-068947

(51) Int. Cl.

| | |
|---|---|
| ***A43B 23/02*** | (2006.01) |
| ***A43B 1/04*** | (2006.01) |
| ***D04B 1/22*** | (2006.01) |
| ***A43B 23/04*** | (2006.01) |
| ***A43B 23/26*** | (2006.01) |

(52) U.S. Cl.

CPC ..... *A43B 1/04* (2013.01); *A43B 23/0245* (2013.01); *A43B 23/042* (2013.01);

(Continued)

(58) Field of Classification Search

CPC .... A43B 1/04; A43B 3/04; A43B 3/08; A43B 23/04; A43B 23/042; A43B 23/045; A43B 23/047; A43B 23/26

See application file for complete search history.

(56) References Cited

U.S. PATENT DOCUMENTS 2,582,298 A 1/1952 Ushakoff
4,297,796 A * 11/1981 Stirtz ..... A43B 13/18 36/28

(Continued)

FOREIGN PATENT DOCUMENTS

| | | |
|---|---|---|
| CN | 2220179 Y | 2/1996 |
| JP | 8-280405 A | 10/1996 |
| WO | 2014/013790 A1 | 1/2014 |

OTHER PUBLICATIONS

Communication cited in EP15769222.9 dated Dec. 15, 2017, 8 pages.

(Continued)

*Primary Examiner* — Ted Kavanaugh
(74) *Attorney, Agent, or Firm* — Rothwell, Figg, Ernst & Manbeck, P.C.

(57) ABSTRACT

There is provided a shoe upper excelling in productivity, and a method for knitting the same. A shoe upper (1) includes a left side intermediate knitted fabric portion (5L) connecting a left side edge portion of a tongue (4) and an instep cover section (3), and a right side intermediate knitted fabric portion (5R) connecting a right side edge portion of the tongue (4) and the instep cover section (3). In such shoe upper (1), a width of an end of the tongue (4) is formed wider on a foot insertion opening (7) side than on a toe side, both side edge portions of the tongue (4) are overlapped with the instep cover section (3) in a thickness direction thereof, and the instep cover section (3), the tongue (4), and both the intermediate knitted fabric portions (5L, 5R) are all integrally knitted in a seamless manner.

9 Claims, 4 Drawing Sheets

(52) U.S. Cl.
CPC ..... *A43B 23/047* (2013.01); *A43B 23/26* (2013.01); *D04B 1/22* (2013.01); *D10B 2501/043* (2013.01)

(56) References Cited

U.S. PATENT DOCUMENTS

| | | | | |
|---|---|---|---|---|
| 5,337,492 | A * | 8/1994 | Anderie | A43B 13/181 36/114 |
| 7,350,320 | B2 * | 4/2008 | Chandler | A43B 13/14 36/28 |
| 8,448,474 | B1 | 5/2013 | Tatler et al. | |
| 2006/0201028 | A1 * | 9/2006 | Chan | A43B 7/142 36/28 |
| 2008/0115389 | A1 * | 5/2008 | Hsieh | A43B 13/181 36/30 A |
| 2013/0212907 | A1 | 8/2013 | Dua et al. | |
| 2014/0109441 | A1 * | 4/2014 | McDowell | A43B 7/085 36/103 |
| 2014/0245545 | A1 * | 9/2014 | Meir | A43B 23/0245 12/142 G |
| 2015/0128448 | A1 * | 5/2015 | Lockyer | A43B 7/1415 36/28 |
| 2015/0173458 | A1 | 6/2015 | Ikenaka | |

OTHER PUBLICATIONS

International Search Report issued in PCT/JP2015/055450 dated May 19, 2015, 1 page.

* cited by examiner

SHOE UPPER, AND METHOD FOR KNITTING SHOE UPPER

CROSS REFERENCE TO RELATED APPLICATION

This application is a 35 U.S.C. 371 National Phase Entry Application from PCT/JP2015/055450, filed Feb. 25, 2015, which claims the benefit of Japanese Patent Application No. JP2014-068947 filed on Mar. 28, 2014, the disclosures of which are incorporated herein in their entirety by reference.

TECHNICAL FIELD

The present invention relates to a shoe upper and a method for knitting the same.

BACKGROUND ART

A shoe includes a shoe upper with a sole cover section that covers a sole of a wearer, and an instep cover section that covers a portion on an instep side of the wearer. In outdoor shoes, an outer sole made of synthetic resin and the like is attached to the sole cover section of the shoe upper.

In recent years, attempts have been made to form the instep cover section, of the sole cover section and the instep cover section configuring the shoe upper, with one knitted fabric to produce the shoe with high productivity. In Patent Document 1, for example, the instep cover section in a planarly developed state is produced with one knitted fabric, and such instep cover section is joined to the outer sole made of synthetic resin and the like along with the sole cover section to complete the shoe. Patent Document 1 further discloses a technique of integrally knitting a tongue with the instep cover section. The tongue is a member provided for the instep of the wearer to enhance the fitting property of the shoe upper.

PRIOR ART DOCUMENT

Patent Document

[Patent Document 1]
U.S. Pat. No. 8,621,891

DISCLOSURE OF THE INVENTION

Problems to be Solved by the Invention

In the knitting method of Patent Document 1, a left side portion and a right side portion of the instep cover section, as well as the tongue are knitted in a state arranged side by side in a knitting width direction on one needle bed (see FIGS. 36A to 36G of Patent Document 1, etc.). Then, side edge portions of the tongue are overlapped with the left side portion and the right side portion of the instep cover section in a thickness direction thereof using transfer and the like to connect the tongue and the instep cover section. However, as the tongue and the instep cover section need to be overlapped, they cannot be simultaneously knitted.

Furthermore, in the knitting method of Patent Document 1, the portions on the heel side of the instep cover section are not connected, and hence the heel side portions of the left side portion and the right side portion of the instep cover section need to be connected by sewing. Such sewing task is very cumbersome, and is a factor that lowers the productivity of the shoe upper.

The present invention has been made in view of the above circumstances, and an object of the present invention is to provide a shoe upper in which the tongue to be overlapped with the instep cover section in a thickness direction of the instep cover can be easily knitted and which excels in productivity, and a method for knitting the same.

Means for Solving the Problems

An aspect of the present invention relates to a shoe upper including an instep cover section that covers a portion on an instep side of a wearer, and a tongue connected to a portion on a toe side of the instep cover section in a seamless manner and provided for the instep of the wearer. The shoe upper of the invention includes a left side intermediate knitted fabric portion connecting a left side edge portion of the tongue and the instep cover section, and a right side intermediate knitted fabric portion connecting a right side edge portion of the tongue and the instep cover section. In the shoe upper of this invention, a width of an end of the tongue is formed wider on a foot insertion opening side than on a toe side and both side edge portions of the tongue are overlapped with the instep cover section in a thickness direction of the instep cover section; and the instep cover section, the tongue, and both the intermediate knitted fabric portions are all integrally knitted in a seamless manner.

According to one aspect of the shoe upper of the present invention, the left side intermediate knitted fabric portion and the right side intermediate knitted fabric portion are tucked in to an inner side of the instep cover section.

According to one aspect of the shoe upper of the present invention, the left side intermediate knitted fabric portion and the right side intermediate knitted fabric portion are knitted with an elastic knitting yarn.

According to one aspect of the shoe upper of the present invention, the instep cover section includes a plurality of first eyelet holes through which to pass a shoelace; the left side intermediate knitted fabric portion and the right side intermediate knitted fabric portion include a plurality of second eyelet holes through which to pass the shoelace; and the second eyelet holes are formed at positions that overlap with the first eyelet holes when the left side intermediate knitted fabric portion and the right side intermediate knitted fabric portion are tucked in to the inner side of the instep cover section.

An aspect of the present invention relates to a method for knitting a shoe upper for knitting, in a seamless manner, an instep cover section that covers a portion on an instep side of a wearer, and a tongue connected to a portion on a toe side of the instep cover section and provided for the instep of the wearer, using a flat knitting machine including a one-side needle bed and an other-side needle bed disposed opposite to each other. The method for knitting the shoe upper of the present invention can be performed according to a first method for knitting the shoe upper or a second method for knitting the shoe upper described below.

The first method for knitting the shoe upper is a method for knitting the shoe upper for knitting, in a seamless manner, the tongue, a left side intermediate knitted fabric portion connecting a left side edge portion of the tongue and the instep cover section, and a right side intermediate knitted fabric portion connecting a right side edge portion of the tongue and the instep cover section, along with the instep cover section, according to the following conditions A to C.

[Condition A] Knit from an instep side toward a sole side of the shoe upper or knit from the sole side toward the instep side of the shoe upper.

[Condition B] Sequentially knit each section configuring the shoe upper, at least a left side portion and a right side portion of the instep cover section being knitted with the one-side needle bed and the other-side needle bed, respectively, in the knitting,

[Condition C] Form a width of an end of the tongue wider on a foot insertion opening side than on a toe side.

The second method for knitting the shoe upper is a method for knitting a shoe upper for knitting, in a seamless manner, the tongue, the left side intermediate knitted fabric portion connecting a left side edge portion of the tongue and the instep cover section, and a right side intermediate knitted fabric portion connecting a right side edge portion of the tongue and the instep cover section, along with the instep cover section, according to the following conditions D to F.

[Condition D] Knit from a heel side toward a toe side of the shoe upper or knit from the toe side toward the heel side of the shoe upper.

[Condition E] Knit a left side portion of each section configuring the shoe upper in a state arranged side by side without overlapping in a longitudinal direction of the needle beds with the one-side needle bed, and knit a right side portion of each section in a state arranged side by side without overlapping in the longitudinal direction of the needle beds with the other-side needle bed.

[Condition F] Form a width of an end of the tongue wider on a foot insertion opening side than on a toe side.

In the conditions B and E, a part of the left side portion may be knitted in a state temporarily moved to the other-side needle bed when forming a knitting pattern (e.g., rib structure), in which front stitches and back stitches coexist, in the left side portion knitted with the one-side needle bed. Similarly, when forming a coexisting pattern in the right side portion knitted with the other-side needle bed, a part of the right side portion may be knitted in a state temporarily moved to the one-side needle bed.

Effects of the Invention

The shoe upper of the present invention excels in productivity as the tongue overlapping with the instep cover section in the thickness direction can be easily knitted, and the tongue is integrally knitted with the instep cover section in advance. Furthermore, the shoe upper of the present invention does not require a post-process for forming the shoe upper into a three-dimensional form such as sewing since the shoe upper is three-dimensionally knitted in a seamless manner.

The left side intermediate knitted fabric portion and the right side intermediate knitted fabric portion are tucked in to the inner side of the instep cover section, so that a shoe upper in which the portion where the intermediate knitted fabric portions are tucked in to form a double layer is reinforced is obtained.

The intermediate knitted fabric portion having excellent stretchability can be formed by knitting the intermediate knitted fabric portions with an elastic knitting yarn, so that a shoe upper that is easy to wear and that excels in fitting property can be obtained.

According to the method for knitting the shoe upper of the present invention, on the other hand, the tongue that overlaps with the instep cover section in the thickness direction can be easily manufactured without using a complex knitting operation in the shoe upper of the present invention. Furthermore, according to the method for knitting the shoe upper of the present invention, a three-dimensional shoe upper can be knitted, and hence the post-process for forming the shoe upper into a three-dimensional form such as sewing is not required.

MODE FOR CARRYING OUT THE INVENTION

Embodiments of a shoe upper and a method for knitting the same of the present invention will be hereinafter described based on the drawings. In the embodiments, a two-bed flat knitting machine including at least one-side needle bed and the other-side needle bed disposed opposite to each other in a front and back direction, stitches being transferrable between the needle beds, is used. The flat knitting machine to be used is, of course, not limited to the two-bed flat knitting machine, and for example, may be a four-bed flat knitting machine.

First Embodiment

Configuration of Shoe Upper

Figure 1:
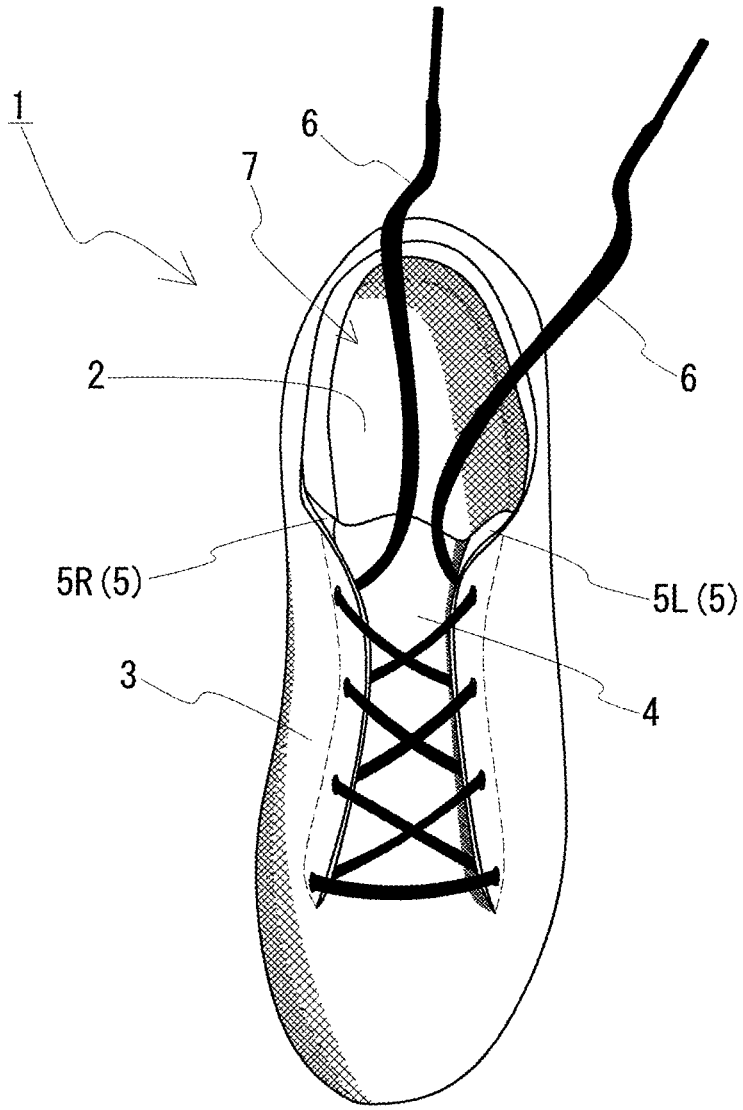
FIG. 1 is a schematic top view of a shoe upper of a first embodiment attached with a shoelace.
Figure 2:
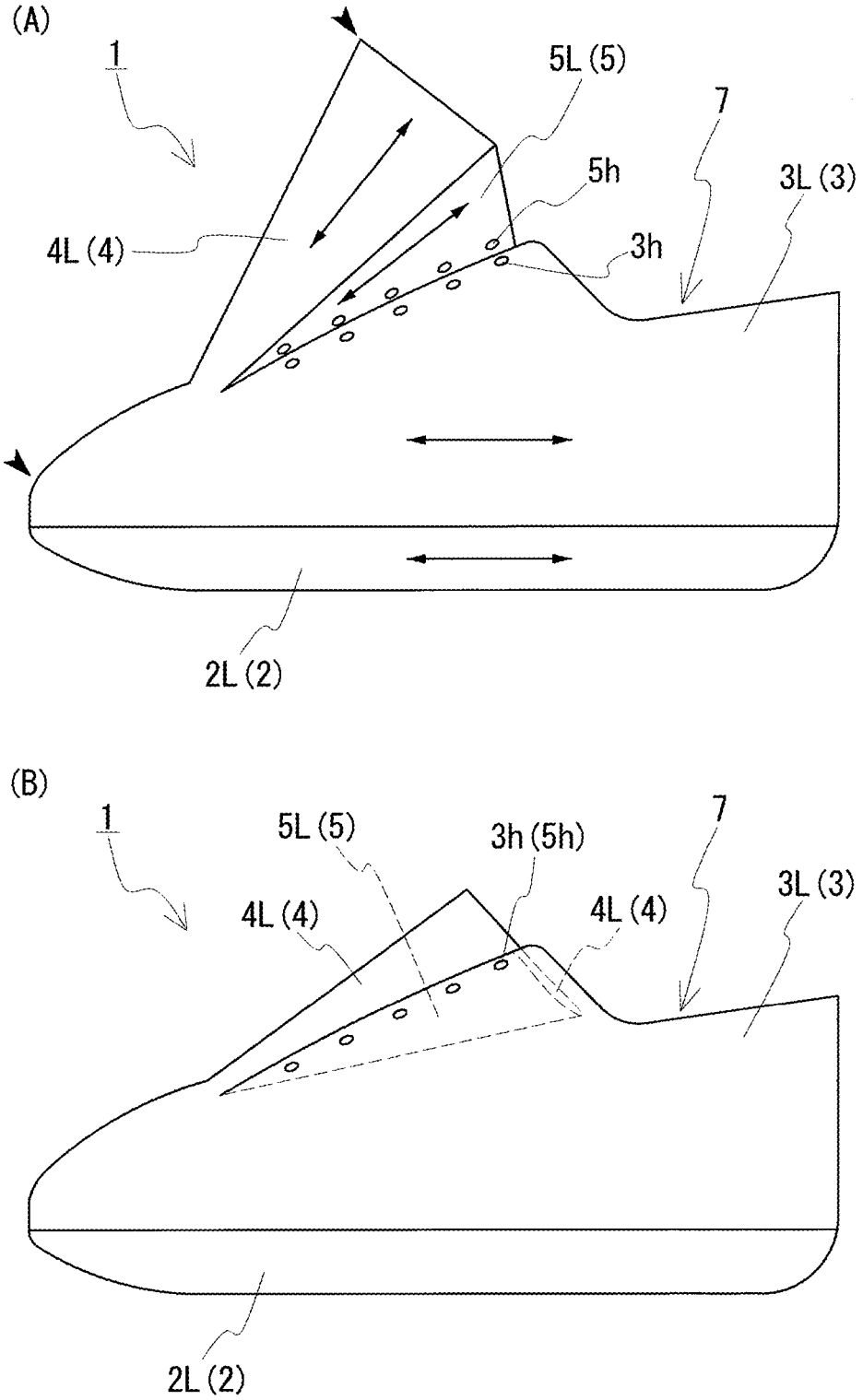
FIG. 2(A) is a schematic left side view of the shoe upper of the first embodiment not attached with the shoelace.
FIG. 2(B) is a schematic left side view of the shoe upper in which a left side intermediate knitted fabric portion is tucked in to the inner side of the instep cover section.
Figure 3:
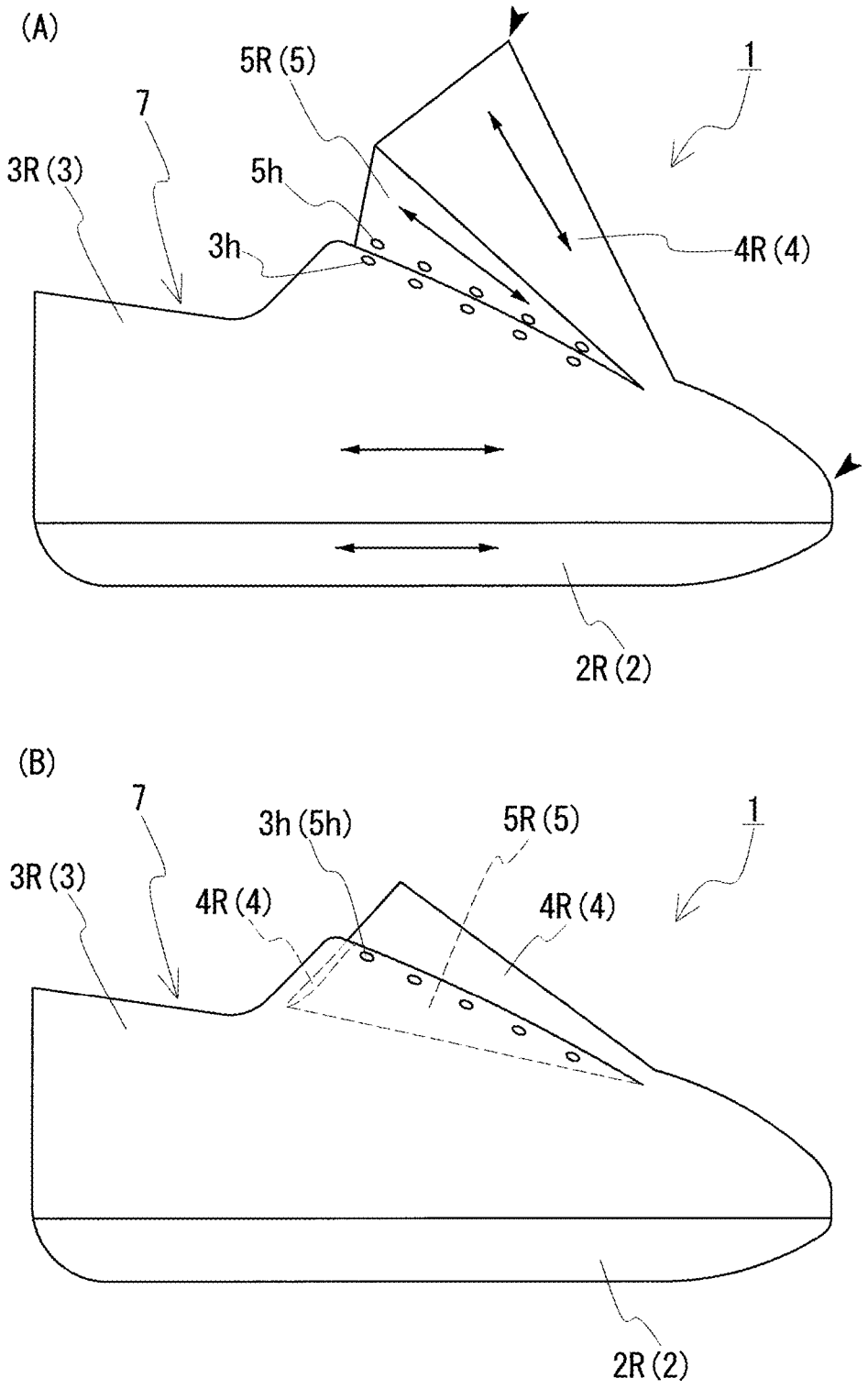
FIG. 3(A) is a schematic right side view of the shoe upper of the first embodiment not attached with the shoelace.
FIG. 3(B) is a schematic right side view of the shoe upper in which a right side intermediate knitted fabric portion is tucked in to the inner side of the instep cover section.

A shoe upper 1 shown in FIGS. 1 to 3 includes a sole cover section 2 that covers a sole of the wearer, an instep cover section 3 that covers a portion on an instep side of the wearer, and a tongue 4, which is provided for the instep of the wearer and connected in a seamless manner to a portion on a toe side of the instep cover section 3. A shoelace 6 is attached to the edge of the instep cover section 3 facing the tongue 4. The shoe upper 1 may also include an outer sole (not shown) on the outer side of the sole cover section 2. The main characteristics of the shoe upper 1 of this embodiment are as follows.

[1] A left side intermediate knitted fabric portion 5L (see especially FIG. 2(A)) connecting the left side edge portion of the tongue 4 and the instep cover section 3, and a right side intermediate knitted fabric portion 5R (see especially FIG. 3(A)) connecting the right side edge portion of the tongue 4 and the instep cover section 3 are arranged. The intermediate knitted fabric portion 5 (5L, 5R) is a configuration that is not equipped in the conventional shoe upper. In the present embodiment, a boundary of the instep cover section 3 and the intermediate knitted fabric portion 5 is mountain-folded and a boundary of the intermediate knitted fabric portion 5 and the tongue 4 is valley folded, so that the intermediate knitted fabric portion 5 is tucked in to the inner side of the instep cover section 3.

[2] A width of an end of the tongue 4 is formed wider on a foot insertion opening 7 side than on a toe side, and both side edge portions of the tongue 4 are overlapped with the instep cover section 3 in the thickness direction (see dotted line of FIGS. 1, 2(B), and 3(B)).

[3] The sole cover section 2, the instep cover section 3, the tongue 4, and both the intermediate knitted fabric portions 5L, 5R are all integrally knitted in a seamless manner. The sole cover section 2 may be prepared separate from the instep cover section 3, and connected to the instep cover section 3 afterwards.

The left and right allocation of each section 2, 3, 4, and 5 such as the intermediate knitted fabric portion 5 and the tongue 4 is not particularly limited, and may be appropriately changed in accordance with the shape of the foot. However, the allocation is preferably about 1:1.

The configurations of [1] to [3] are formed due to the method for knitting the shoe upper 1. The method for knitting the shoe upper 1 will be described in detail later, but briefly, the relevant knitting method is a method for knitting the shoe upper for knitting, in a seamless manner, the tongue 4, the left side intermediate knitted fabric portion 5L and the right side intermediate knitted fabric portion 5R along with the sole cover section 2 and the instep cover section 3, according to the following conditions A to C.

[Condition A] Knit from the instep side toward the sole side of the shoe upper 1, or knit from the sole side toward the instep side of the shoe upper 1. That is, knit the shoe upper 1 with a length direction (heel to toe direction) of the shoe upper 1 directed in a longitudinal direction of the needle beds.

[Condition B] Sequentially knit the sole cover section 2, the instep cover section 3, the intermediate knitted fabric portion 5, and the tongue 4. Upon knitting, knit at least a left side portion (main body left portion 3L) and a right side portion (main body right portion 3R) of the instep cover section 3 with the one-side needle bed and the other-side needle bed, respectively.

[Condition C] Form the width of the end of the tongue 4 wider on the foot insertion opening 7 side than on the toe side.

The sole cover section 2, the instep cover section 3, and the tongue 4 are preferably knitted with a fusible knitting yarn including a heat fusible yarn. If each section 2, 3, 4 is knitted with the fusible knitting yarn, the shoe upper 1 can be molded three-dimensionally when the shoe upper 1 is fitted to a last (foot model) and subjected to thermal processing. Each section 2, 3, 4 may, of course, be knitted with a non-fusible knitting yarn not including the heat fusible yarn, or some of the sections 2, 3, 4 may be knitted with the fusible knitting yarn and the remaining section may be knitted with the non-fusible knitting yarn.

The left side intermediate knitted fabric portion 5L and the right side intermediate knitted fabric portion 5R are knitted with a knitting yarn fed from a yarn feeder different from that for the other sections 2, 3, 4. The intermediate knitted fabric portions 5L, 5R are preferably knitted with an elastic knitting yarn including an elastic yarn. If both the intermediate knitted fabric portions 5L, 5R are knitted with the elastic knitting yarn, both the intermediate knitted fabric portions 5L and 5R stretch when inserting the foot into the shoe upper 1 thus enabling the shoe to be easily worn, and both the intermediate knitted fabric portions 5L and 5R contract when the shoe upper 1 is worn thus realizing the shoe upper 1 excelling in fitting property. In addition, the intermediate knitted fabric portions 5L, 5R can be easily tucked in to the inner side of the instep cover section 3 by knitting the intermediate knitted fabric portions 5L, 5R with a soft knitting yarn.

A plurality of first eyelet holes 3*h* through which to pass the shoelace 6 (see FIG. 1) is formed in the instep cover section 3. Furthermore, a plurality of second eyelet holes 5*h* through which to pass the shoelace 6 is formed in the left side intermediate knitted fabric portion 5L (see FIG. 2(A)) and the right side intermediate knitted fabric portion 5R (see FIG. 3(A)). The second eyelet holes 5*h* are provided at positions that overlap with the first eyelet holes 3*h* when the left side intermediate knitted fabric portion 5L and the right side intermediate knitted fabric portion 5R are tucked in to the inner side of the instep cover section 3, as shown in FIGS. 2(B) and 3(B).

When using the shoe upper 1 having the configuration described above, the intermediate knitted fabric portions 5L, 5R are first tucked in to the inner side of the instep cover section 3, and the first eyelet holes 3*h* and the second eyelet holes 5*h* are overlapped, as shown in FIGS. 2(B) and 3(B). The shoelace 6 is passed through the overlapped eyelet holes 3*h* (5*h*) to complete the shoe upper 1 shown in FIG. 1.

<<Method for Knitting Shoe Upper>>

The shoe upper 1 can be knitted with a knitting method α of knitting from the instep side toward the sole side of the shoe upper 1, or with a knitting method β of knitting from the sole side toward the instep side of the shoe upper 1. In the present embodiment, an example of the knitting method α will be described with reference to FIGS. 2(A) and 3(A). An arrow with an arrow head at both ends in FIGS. 2(A) and 3(A) indicates a knitting width direction.

First, a set up section extending across both the one-side needle bed and the other-side needle bed is knitted (positions of both ends of the set up section are illustrated with a wedge shaped arrow in FIGS. 2(A) and 3(A)). A tongue left portion 4L, which is the left side portion, and a tongue right portion 4R, which is the right side portion, of the tongue 4 are respectively knitted with the one-side needle bed and the other-side needle bed based on the set up section. The set up section may not necessarily be at the middle in the width direction of the tongue 4. The tongue left portion 4L and the tongue right portion 4R can be knitted by flechage knitting using different yarn feeders. The width of the end on the foot insertion opening 7 side of the tongue 4 can be formed wider than the width of the end on the toe side of the tongue 4 by carrying out flechage knitting many times on the foot insertion opening 7 side. The tongue 4 thus can be easily formed by increasing and decreasing stitches. A part of the toe side of the instep cover section 3 on the toe side with respect to the tongue 4 may be knitted through flechage knitting with the knitting of the tongue 4.

After the knitting of the tongue 4 is finished, the left side intermediate knitted fabric portion 5L and the right side intermediate knitted fabric portion 5R are knitted with the one-side needle bed and the other-side needle bed, respectively. The left side intermediate knitted fabric portion 5L is knitted following the terminating end in the wale direction of the tongue left portion 4L, and the right side intermediate knitted fabric portion 5R is knitted following the terminating end in the wale direction of the tongue right portion 4R. The intermediate knitted fabric portions 5L, 5R can each be knitted through flechage knitting using different yarn feeders. In this case, the line of the terminating end in the wale direction of both the intermediate knitted fabric portions 5L, 5R may be curved toward the tongue 4 by changing the position of and the number of times of carrying out the flechage knitting. The line becomes a boundary line of the instep cover section 3 and both the intermediate knitted fabric portions 5L, 5R, where the shoe upper 1 of various designs can be produced by curving such line. The second eyelet holes 5*h* of both the intermediate knitted fabric portions 5L, 5R can be formed using a known stitch move and the like.

Next, a main body left portion 3L, which is the left side portion, and a main body right portion 3R, which is the right side portion, of the instep cover section 3 are knitted with the one-side needle bed and the other-side needle bed, respectively. The main body left portion 3L is knitted following the terminating end in the wale direction of the left side intermediate knitted fabric portion 5L, and the main body right portion 3R is knitted following the terminating end in the wale direction of the right side intermediate knitted fabric portion 5R. The main body left portion 3L and the main body right portion 3R can be knitted by appropriately using the flechage knitting, the C-shaped knitting and the tubular knitting. At the portions of the heel and the toe, the main body left portion 3L and the main body right portion 3R may be connected using the C-shaped knitting or the tubular knitting. The first eyelet holes 3*h* of the instep cover section 3 can also be formed using the known stitch move and the like.

Furthermore, a sole left portion 2L, which is the left side portion, and a sole right portion 2R, which is the right side portion, of the sole cover section 2 are knitted with the one-side needle bed and the other-side needle bed, respectively. The sole left portion 2L is knitted following the terminating end in the wale direction of the main body left portion 3L, and the sole right portion 2R is knitted following the terminating end in the wale direction of the main body right portion 3R. The sole left portion 2L and the sole right portion 2R can be respectively knitted with the flechage knitting using different yarn feeders.

Lastly, the sole left portion 2L and the sole right portion 2R are connected to complete the shoe upper 1. The method for connecting the sole left portion 2L and the sole right portion 2R is not particularly limited, and for example, a known bind-off process can be used. Alternatively, the sole left portion 2L and the sole right portion 2R may be connected through front-back knitting of alternately knitting the stitches on the front and back needle beds. The portions 2L, 2R can be connected in a much shorter period of time through the front-back knitting that does not require transfer than through the bind-off process that requires transfer. Since a connecting portion (i.e., knitting terminating portion of the shoe upper 1) can be fused by the thermal process, to be described later, the connection strength of the connecting portion can be ensured regardless of which connecting method is used to form the connecting portion. Furthermore, since the connecting portion is located at a position that cannot be seen when the shoe upper 1 is worn, the appearance of the shoe upper 1 will not be impaired by the connecting portion.

According to the procedure described above, the shoe upper 1 can be knitted without forming widening stitches and narrowing stitches, carrying out complicated transfer, and the like. This is because each section 4, 5, 3, 2 configuring the shoe upper 1 is sequentially knitted.

In the shoe upper 1 described above, the knitting width direction of the sole cover section 2, the instep cover section 3, the tongue 4, the left side intermediate knitted fabric portion 5L, and the right side intermediate knitted fabric portion 5R is directed in the length direction of the shoe upper 1 (see direction of double-headed arrow of FIGS. 2(A) and 3(A)). As the stitches of the shoe upper 1 are directed in the same direction, the shoe upper 1 that has satisfactory appearance and that excels in wearing comfortability is realized.

After the knitting of the shoe upper 1 is finished, both the intermediate knitted fabric portions 5L, 5R are tucked in to the inner side of the instep cover section 3, and the eyelet holes 3*h* of the instep cover section 3 and the eyelet holes 5*h* of the intermediate knitted fabric portions 5L, 5R are aligned, as already described using FIGS. 2(B) and 3(B). The entire shoe upper 1 is then fitted into the last and subjected to thermal processing to three-dimensionally mold the shoe upper 1. The connecting portion of the sole left portion 2L and the sole right portion 2R is fused by such thermal processing, so that the portions 2L, 2R can be prevented from separating. After the thermal processing, the shoelace 6 is passed through the eyelet holes 3*h* (5*h*) to complete the shoe upper 1 shown in FIG. 1.

Alternative Embodiment 1-1

The shoe upper 1 shown in FIG. 1 can also be produced through the knitting method β in which the knitting starts from the sole cover section 2 side and the knitting terminates on the instep cover section 3 side, as already described above. In this case, the set up section is formed across the one-side needle bed and the other-side needle bed, the sole cover section 2, the instep cover section 3, and the intermediate knitted fabric portions 5L, 5R, and the tongue 4 are knitted in such order based on the set up section, and lastly, the tongue left portion 4L and the tongue right portion 4R are connected. The left side portions 2L, 3L, 4L, 5L and the right side portions 2R, 3R, 4R, 5R of the shoe upper 1 are, of course, knitted with the one-side needle bed and the other-side needle bed, respectively.

Alternative Embodiment 1-2

In the first embodiment, the set up section can be arranged at a portion to become the folding line at the time of using the shoe upper 1 such as the boundary portion of the intermediate knitted fabric portion 5 and the instep cover section 3, the boundary portion of the intermediate knitted fabric portion 5 and the tongue 4, and the like. For example, set up can be carried out between the left side intermediate knitted fabric portion 5L and the main body left portion 3L, and knitting is carried out in the order of main body left portion 3L→sole left portion 2L with the one-side needle bed, and knitting is carried out in the order of left side intermediate knitted fabric portion 5L→tongue left portion 4L→tongue right portion 4R→right side intermediate knitted fabric portion 5R→main body right portion 3R→sole right portion 2R with the other-side needle bed. The set up section is less likely to stand out and the appearance of the shoe upper 1 can be enhanced by arranging the set up section at the portion to become the folding line.

In the alternative embodiment 1-1 as well, the knitting terminating portion may be arranged at the boundary portion of each section 5, 3 (5, 4) so that the knitting terminating portion is less likely to stand out.

Second Embodiment

In the second embodiment, an example of knitting the shoe upper 1 shown in FIG. 1 vertically on the needle beds will be described. Specifically, the tongue 4, the left side intermediate knitted fabric portion 5L connecting the left side edge portion of the tongue 4 and the instep cover section 3, and the right side intermediate knitted fabric portion 5R connecting the right side edge portion of the tongue 4 and the instep cover section 3 are knitted along with the sole cover section 2 and the instep cover section 3 in a seamless manner according to the following conditions D to F.

[Condition D] Knit from the heel side toward the toe side of the shoe upper 1, or knit from the toe side toward the heel side of the shoe upper 1. That is, knit the shoe upper 1 with the height direction (direction orthogonal to the heel to toe direction) of the shoe upper 1 directed in the longitudinal direction of the needle beds.

[Condition E] Knit the left side portion of each section 2, 3, 4, 5 configuring the shoe upper 1 in a state arranged side by side without overlapping in the longitudinal direction of the needle beds with the one-side needle bed, and knit the right side portion of each section 2, 3, 4, 5 in a state arranged side by side without overlapping in the longitudinal direction of the needle beds with the other-side needle bed.

[Condition F] Form the width of the end of the tongue 4 wider on the foot insertion opening 7 side than on the toe side.

<<Example of Knitting from Heel Side Toward Toe Side>>

Figure 4:
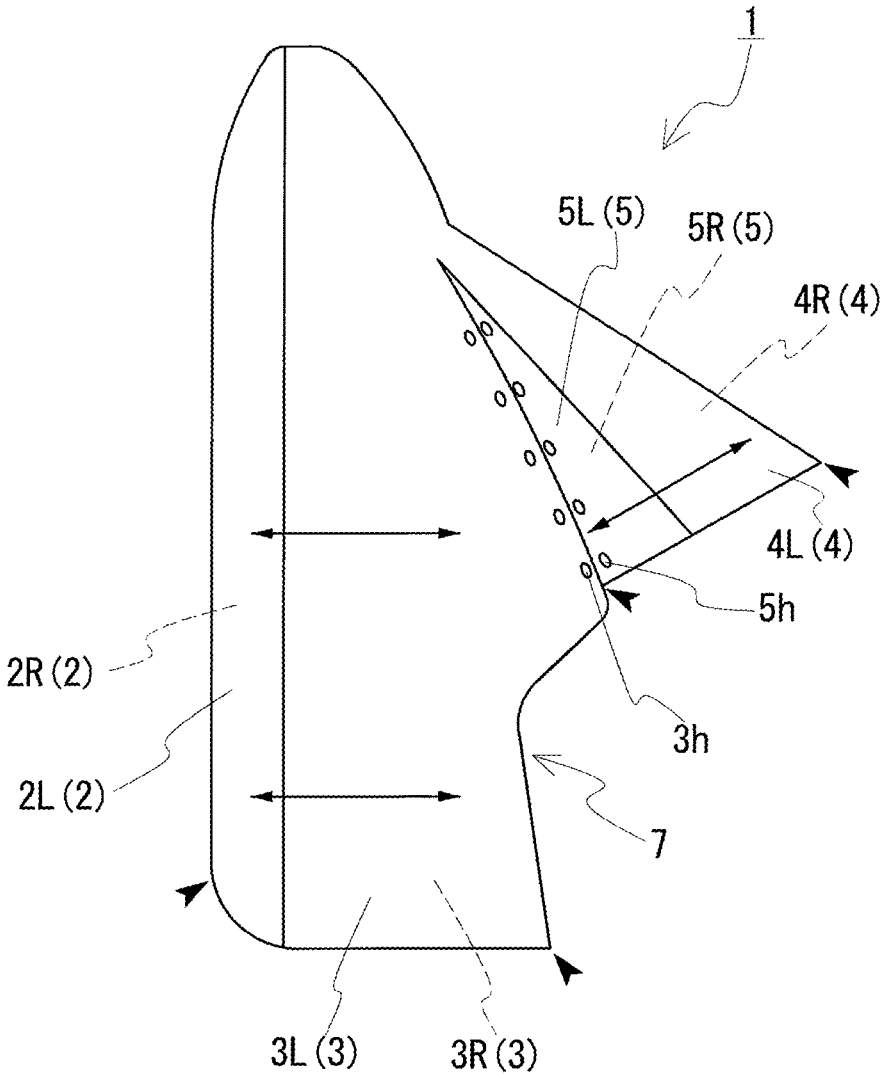
FIG. 4 is a schematic left side view of a shoe upper of a second embodiment not attached with the shoelace.

An example of knitting from the heel side toward the toe side of the shoe upper 1 will first be described as a knitting method of the second embodiment that satisfies the conditions described above. Upon making the description, the left side view of the shoe upper 1 shown in FIG. 4 will be used. The illustration of the right side view of the shoe upper 1 is omitted, but the right side portions 2R, 3R, 4R, 5R of the shoe upper 1 can be assumed to be arranged on the far side in the plane of the drawing of FIG. 4. The knitting width direction in the second embodiment is indicated with a double-headed arrow in FIG. 4.

When knitting the shoe upper 1 from the heel side, the set up section on the heel side is formed (positions of both ends of the set up section are illustrated with a wedge shaped arrow). The instep cover section 3 and the sole cover section 2 are knitted using the flechage knitting and the C-shaped knitting based on the setup section. The sections 2, 3 are knitted up to immediately before the intermediate knitted fabric portion 5 and the tongue 4. The curve shape and the like of the foot insertion opening 7 can be formed using widening and narrowing. The method for setting up the heel, the shape of the heel, and the positions to perform widening and narrowing are not particularly limited. For example, the technique described in WO 2014/013790 A1 (hereinafter referred to as Document 1) can be used.

The set up section of the left side intermediate knitted fabric portion 5L and the tongue left portion 4L (see wedge shaped arrow near the tongue 4) is formed at the position not overlapping with the main body left portion 3L and the sole left portion 2L on the one-side needle bed, and the set up section of the right side intermediate knitted fabric portion 5R and the tongue right portion 4R is formed at the position not overlapping with the main body right portion 3R and the sole right portion 2R on the other-side needle bed. The left side portions 2L, 3L, 4L, 5L of the shoe upper 1 are knitted in a parallel arranged state on the one-side needle bed, and the right side portions 2R, 3R, 4R, 5R of the shoe upper 1 are knitted in a parallel arranged state on the other-side needle bed. The knitting width of the tongue 4 is made smaller continuously or in a stepwise manner toward the toe side by narrowing. Thus, the width of the end of the tongue 4 can be formed wider on the foot insertion opening 7 side than on the toe side.

After the knitting of the tongue 4 and the intermediate knitted fabric portion 5 is finished, the instep cover section 3 and the sole cover section 2 on the toe side with respect to the end on the toe side of the tongue 4 are knitted through a combination of the tubular knitting and the C-shaped knitting involving widening and narrowing. The left side portions 2L, 3L and the right side portions 2R, 3R of the sections 2, 3 are respectively knitted with the one-side needle bed and the other-side needle bed. A part of the instep cover section 3 is knitted in continuation to the terminating end in the wale direction of the tongue 4. The tongue 4 is thereby connected to the instep cover section 3 in a seamless manner. Lastly, the main body left portion 3L and the main body right portion 3R are connected by knitting at the position of the toe. The connecting method is not particularly limited, and for example, the technique described in Document 1 can be used.

<<Example of Knitting from Toe Side Toward Heel Side>>

First, the set up section (not illustrated) on the toe side is formed. The instep cover section 3 and the sole cover section 2 are knitted using the tubular knitting and the C-shaped knitting involving widening, based on the set up section. Both of the sections 2, 3 are knitted up to immediately before the tongue 4.

The left side portions 2L, 3L, 4L, 5L of the shoe upper 1 are knitted in a parallel arranged state on the one-side needle bed, and the right side portions of the shoe upper 1 are knitted in a parallel arranged state on the other-side needle bed. In this case, the tongue 4 and the intermediate knitted fabric portion 5 are knitted in continuation to the wale direction of some stitches of the stitches of the instep cover section 3 held on the one-side needle bed and the other-side needle bed, and the instep cover section 3 is knitted in continuation to the wale direction of the remaining stitches. As such, each section 2, 3, 4, 5 is connected in a seamless manner. Upon knitting the tongue 4, the knitting width of the tongue 4 is made larger continuously or in a stepwise manner toward the heel side by widening. Thus, the width of the end of the tongue 4 can be formed wider on the foot insertion opening 7 side than on the toe side.

After the knitting of the tongue 4 and the intermediate knitted fabric portion 5 is finished, the instep cover section 3 and the sole cover section 2 on the foot insertion opening 7 side with respect to the end on the foot insertion opening 7 side of the tongue 4 and the intermediate knitted fabric portion 5 are knitted using the flechage knitting and the C-shaped knitting. The left side portions 2L, 3L and the right side portions 2R, 3R of the sections 2, 3 are respectively knitted with the one-side needle bed and the other-side needle bed. Lastly, the main body left portion 3L and the main body right portion 3R are connected by knitting at the position of the heel.

In the shoe upper 1 of the second embodiment, the knitting width direction of each section 2, 3, 4, 5 is directed in a height direction (direction substantially orthogonal to the double headed arrow of FIGS. 2(A) and 3(A)) of the shoe upper 1. In this case, the line extending in the height direction of the shoe upper 1 can be formed in the instep cover section 3 by simply changing the knitting yarns in the process of the knitting of the instep cover section 3. If a knitting yarn that is less likely to stretch is used for the knitting yarn of the line, the relevant portion can serve to suppress the stretching. Such line also becomes an accent in terms of design.

Third Embodiment

In the third embodiment, a shoe upper in which the left side intermediate knitted fabric portion 5L and the right side intermediate knitted fabric portion 5R are knitted with a draw thread will be described based on FIGS. 2(A) and 3(A).

In the shoe upper 1 of the third embodiment, a part of or the entire part of the left side intermediate knitted fabric portion 5L and the right side intermediate knitted fabric portion 5R are knitted with the draw thread. In this case, after the shoe upper 1 is completed, the draw thread is removed from the shoe upper 1 to produce the shoe upper 1 in which the left side edge portion and the right side edge portion of the tongue 4 are separated from the instep cover section 3. For example, the shoe upper 1 in which a short notch is formed at the portion on the foot insertion opening 7 side of the intermediate knitted fabric portions 5L, 5R is realized by forming one part on the foot insertion opening 7 side of the intermediate knitted fabric portions 5L, 5R with the draw thread.

DESCRIPTION OF REFERENCE NUMERALS

1 shoe upper
2 sole cover section
2L sole left portion
2R sole right portion
3 instep cover section
3L main body left portion
3R main body right portion
3*h* first eyelet hole
4 tongue
4L tongue left portion
4R tongue right portion
5 intermediate knitted fabric portion
5L left side intermediate knitted fabric portion
5R right side intermediate knitted fabric portion
5*h* second eyelet hole
6 shoelace
7 foot insertion opening

The invention claimed is:

1. A shoe upper including an instep cover section configured to cover a portion on an instep side of a wearer, and a tongue connected to a portion on a toe side of the instep cover section in a seamless manner and provided for the instep of the wearer, the shoe upper comprising:

a left side intermediate knitted fabric portion connecting a left side edge portion of the tongue and the instep cover section, and a right side intermediate knitted fabric portion connecting a right side edge portion of the tongue and the instep cover section, wherein a width of an end of the tongue is formed wider on a foot insertion opening side than on a toe side, and both side edge portions of the tongue are overlapped with the instep cover section in a thickness direction of the instep cover section; and the instep cover section, the tongue, and both the intermediate knitted fabric portions are all integrally knitted in a seamless manner.

2. The shoe upper according to claim 1, wherein the left side intermediate knitted fabric portion and the right side intermediate knitted fabric portion are tucked in to an inner side of the instep cover section.

3. The shoe upper according to claim 2, wherein the left side intermediate knitted fabric portion and the right side intermediate knitted fabric portion are knitted with an elastic knitting yarn.

4. The shoe upper according to claim 2, wherein the instep cover section includes a plurality of first eyelet holes through which to pass a shoelace;

the left side intermediate knitted fabric portion and the right side intermediate knitted fabric portion include a plurality of second eyelet holes through which to pass the shoelace; and the second eyelet holes are formed at positions that overlap with the first eyelet holes when the left side intermediate knitted fabric portion and the right side intermediate knitted fabric portion are tucked in to the inner side of the instep cover section.

5. The shoe upper according to claim 1, wherein the left side intermediate knitted fabric portion and the right side intermediate knitted fabric portion are knitted with an elastic knitting yarn.

6. The shoe upper according to claim 5, wherein the instep cover section includes a plurality of first eyelet holes through which to pass a shoelace;

the left side intermediate knitted fabric portion and the right side intermediate knitted fabric portion include a plurality of second eyelet holes through which to pass the shoelace; and the second eyelet holes are formed at positions that overlap with the first eyelet holes when the left side intermediate knitted fabric portion and the right side intermediate knitted fabric portion are tucked in to the inner side of the instep cover section.

7. The shoe upper according to claim 1, wherein the instep cover section includes a plurality of first eyelet holes through which to pass a shoelace;

the left side intermediate knitted fabric portion and the right side intermediate knitted fabric portion include a plurality of second eyelet holes through which to pass the shoelace; and the second eyelet holes are formed at positions that overlap with the first eyelet holes when the left side intermediate knitted fabric portion and the right side intermediate knitted fabric portion are tucked in to the inner side of the instep cover section.

8. A method for knitting a shoe upper comprising knitting, in a seamless manner, an instep cover section configured to cover a portion on an instep side of a wearer, and a tongue connected to a portion on a toe side of the instep cover section and provided for the instep of the wearer, using a flat knitting machine including a one-side needle bed and an other-side needle bed disposed opposite to each other, wherein the tongue, a left side intermediate knitted fabric portion connecting a left side edge portion of the tongue and the instep cover section, and a right side intermediate knitted fabric portion connecting a right side edge portion of the tongue and the instep cover section are knitted, along with the instep cover section, in a seamless manner according to the following conditions A to C:

[Condition A] knit from an instep side toward a sole side of the shoe upper or knit from the sole side toward the instep side of the shoe upper;

[Condition B] sequentially knit each section configuring the shoe upper, at least a left side portion and a right side portion of the instep cover section being knitted with the one-side needle bed and the other-side needle bed, respectively, in the knitting; and

[Condition C] form a width of an end of the tongue wider on a foot insertion opening side than on a toe side, wherein said shoe upper includes an instep cover section configured to cover a portion on an instep side of a wearer, and a tongue connected to a portion on a toe side of the instep cover section in a seamless manner and provided for the instep of the wearer, the shoe upper comprising:

a left side intermediate knitted fabric portion connecting a left side edge portion of the tongue and the instep cover section, and a right side intermediate knitted fabric portion connecting a right side edge portion of the tongue and the instep cover section, wherein a width of an end of the tongue is formed wider on a foot insertion opening side than on a toe side, and both side edge portions of the tongue are overlapped with the instep cover section in a thickness direction of the instep cover section; and the instep cover section, the tongue, and both the intermediate knitted fabric portions are all integrally knitted in a seamless manner.

9. A method for knitting a shoe upper comprising knitting, in a seamless manner, an instep cover section configured to cover a portion on an instep side of a wearer, and a tongue connected to a portion on a toe side of the instep cover section and provided for the instep of the wearer, using a flat knitting machine including a one-side needle bed and an other-side needle bed disposed opposite to each other, wherein the tongue, a left side intermediate knitted fabric portion connecting a left side edge portion of the tongue and the instep cover section, and a right side intermediate knitted fabric portion connecting a right side edge portion of the tongue and the instep cover section are knitted, along with the instep cover section, in a seamless manner according to the following conditions D to F:

[Condition D] knit from a heel side toward a toe side of the shoe upper or knit from the toe side toward the heel side of the shoe upper;

[Condition E] knit a left side portion of each section configuring the shoe upper in a state arranged side by side without overlapping in a longitudinal direction of the needle beds on the one-side needle bed, and knit a right side portion of each section in a state arranged side by side without overlapping in the longitudinal direction of the needle beds with the other-side needle bed; and

[Condition F] form a width of an end of the tongue wider on a foot insertion opening side than a toe side, wherein said shoe upper includes an instep cover section configured to cover a portion on an instep side of a wearer, and a tongue connected to a portion on a toe side of the instep cover section in a seamless manner and provided for the instep of the wearer, the shoe upper comprising:

a left side intermediate knitted fabric portion connecting a left side edge portion of the tongue and the instep cover section, and a right side intermediate knitted fabric portion connecting a right side edge portion of the tongue and the instep cover section, wherein a width of an end of the tongue is formed wider on a foot insertion opening side than on a toe side, and both side edge portions of the tongue are overlapped with the instep cover section in a thickness direction of the instep cover section; and the instep cover section, the tongue, and both the intermediate knitted fabric portions are all integrally knitted in a seamless manner.

* * * * *